US007938910B2

(12) United States Patent
Asplund et al.

(10) Patent No.: US 7,938,910 B2
(45) Date of Patent: May 10, 2011

(54) METHOD FOR WASHING GAS TURBINE COMPRESSOR WITH NOZZLE

(75) Inventors: Peter Asplund, Hasselby (SE); Carl-Johan Hjerpe, Nacka (SE)

(73) Assignee: Gas Turbine Efficiency AB (SE)

( * ) Notice: Subject to any disclaimer, the term of this patent is extended or adjusted under 35 U.S.C. 154(b) by 0 days.

(21) Appl. No.: 12/697,532

(22) Filed: Feb. 1, 2010

(65) Prior Publication Data

US 2010/0132745 A1 Jun. 3, 2010

Related U.S. Application Data

(62) Division of application No. 10/572,762, filed as application No. PCT/SE2004/001370 on Sep. 24, 2004, now Pat. No. 7,760,440.

(30) Foreign Application Priority Data

Sep. 25, 2003 (SE) ..... 0302550

(51) Int. Cl.
*B08B 3/02* (2006.01)

(52) U.S. Cl. ..... 134/22.1; 134/22.18; 134/32; 134/34; 239/543; 239/544

(58) Field of Classification Search ..... 134/21.1, 134/22.18, 32, 34, 42; 239/543, 544
See application file for complete search history.

(56) References Cited

U.S. PATENT DOCUMENTS

| | | | | |
|---|---|---|---|---|
| 2,235,258 | A | 3/1941 | Walter | |
| 2,928,611 | A | 3/1960 | Lauderback et al. | |
| 3,835,810 | A | 9/1974 | Hughes | |
| 4,196,020 | A | 4/1980 | Hornak et al. | |
| 4,415,123 | A | 11/1983 | Ikeuchi | |
| 5,011,540 | A | 4/1991 | McDermott | |
| 5,178,326 | A | 1/1993 | Kukesh et al. | |
| 5,318,254 | A | 6/1994 | Shaw et al. | |
| 5,899,217 | A | 5/1999 | Testman, Jr. | |
| 5,944,483 | A | 8/1999 | Beck et al. | |
| 6,553,768 | B1 * | 4/2003 | Trewin et al. | 60/772 |
| 6,675,437 | B1 | 1/2004 | York | |
| 2002/0001255 | A1 | 1/2002 | Flood et al. | |
| 2004/0026538 | A1 | 2/2004 | Heyse | |
| 2009/0050183 | A1 | 2/2009 | Rice et al. | |

FOREIGN PATENT DOCUMENTS

| | | |
|---|---|---|
| EP | 0 628 477 | 12/1994 |
| WO | 92/14557 | 9/1992 |

* cited by examiner

*Primary Examiner* — Michael Barr
*Assistant Examiner* — Saeed T Chaudhry
(74) *Attorney, Agent, or Firm* — DLA Piper LLP (US)

(57) ABSTRACT

A method for cleaning a gas turbine unit. The invention further relates to a nozzle for use in washing the gas turbine unit. The nozzle is arranged to atomize a wash liquid in the air stream in an air intake of the gas turbine unit and comprises a nozzle body comprising an intake end for intake of said wash liquid and outlet end for exit of said wash liquid. The nozzle further comprises a number of orifices that are connected to the outlet end and respective orifice is arranged at a suitable distance from a center axis of said nozzle body, whereby the local density of the injected wash liquid in a desired area can be increased with preserved droplet size and thereby the efficiency of the cleaning process can be significantly improved at the same time as the risk for damaging the components in the gas turbine unit is significantly reduced.

14 Claims, 6 Drawing Sheets

Vy X - X

Vy X - X

METHOD FOR WASHING GAS TURBINE COMPRESSOR WITH NOZZLE

RELATED APPLICATIONS

This application is a divisional of U.S. patent application Ser. No. 10/572,762, filed on Mar. 21, 2006, which is a 371 of PCT/SE04/01370 filed Sep. 24, 2004, which claims priority to Swedish Application No. 0302550.9 filed Sep. 25, 2003, which is incorporated herein by reference in its entirety.

TECHNICAL FIELD

This invention relates to washing of gas turbines and particularly to a nozzle for washing a gas turbine unit during operation. Further the invention relates to a method for washing of said gas turbine unit under operation.

DESCRIPTION OF PRIOR ART

The invention relates to the general art of washing gas turbine equipped with axial compressors or radial compressors. Gas turbines comprise of a compressor for compressing air, a combustor for combusting fuel together with the compressed air and a turbine driving the compressor. The compressor comprises in turn multiple compression stages, where a compression stage comprises of a rotor disc and subsequent stator disc with vanes.

Gas turbines in operation consumes large quantities of air. The air contains contaminants in form of small particles, called aerosols, that enters the compressor with the air stream. A majority of these particles will follow the air stream and exit the gas turbine with the exhaust. However, there are particles with the properties of sticking on to components in the engine's gas path. These particles build up a coating on the components, reducing the aerodynamic properties. The coating result, in an increase in the surface roughness which result in a decrease in the pressure gain as well as a reduction of the air flow that the compressor compresses. For the gas turbine unit it results in a decrease in efficiency, a reduced mass flow and a reduced pressure ratio. To reduce the contamination modern gas turbines are equipped with filters for filtering of the air to the compressor. These filters can only capture a portion of the particles. To maintain an economic operation of the gas turbine, it is found necessary to regularly clean the compressor gas path components to maintain the good aerodynamic properties.

Different methods for cleaning gas turbine compressors are previously known. To inject crushed nut shells into the air stream is shown to be practical. The disadvantage with the method is that nut shell material may find its way into the internal air system of the gas turbine with the consequence of clogging of channels and valves. Another method for cleaning is based on wetting of the compressor components with detergent. The detergent is injected with nozzles spraying it into the air stream of the compressor.

Stationary gas turbines vary much in size. The largest gas turbines on the market have a rotor diameter in excess of two meters. This means that the air duct upstream of the compressor will thereby also have large geometries. For a gas turbine with a two meter diameter rotor may have more than two meter distance to the opposite duct wall. With these large geometries there may be difficulties in injecting washing fluid into the part of the duct with the core air stream. If the liquid follows the core air stream the surface of the rotor blades and stator vanes will essentially be wetted whereby a good wash will be obtained. If the liquid on the contrary will follow close to the duct wall, the liquid will in an unsatisfactory way wet the blades and vanes. Further, a portion of the liquid will be caught by the boundary layer air stream by the duct wall and will there form a liquid film which is transported into the compressor by the air stream. This liquid will not participate in washing of the compressor and can cause damage of, for example, the liquid fills the gap between the rotor tip and compressor casing.

In contrary to large gas turbines with large geometries there are small gas turbines with moderate dimensions on the inlet air duct. For smaller gas turbines the spray can more easily penetrate in to the core air stream. Experience from actual wash installations on gas turbines show that the spray from conventional nozzles penetrated the air stream some tens of a centimeter. For most small and medium size gas turbines this is sufficient for satisfactory wetting of the rotor blades and stator vanes. One problem is that conventional nozzles can not penetrate the air stream of large gas turbines.

A preferred cleaning method is based on wetting the compressor components with a washing fluid. The fluid is injected through a nozzle that atomizes the liquid into a spray in the air stream entering the compressor. The washing fluid may consist of water or a mixture of water and chemicals. During injection of the wash liquid the gas turbine rotor is cranked with its starter motor. This method is called "crank wash" or "off-line" wash and is characterized by that the gas turbine does not fire fuel during washing. The spray is created by the washing liquid being pumped through the nozzles which then atomizes the fluid. The nozzles are installed on the duct walls upstream of the compressor's inlet or on a frame temporarily installed in the duct.

The method is characterized by the compressor components soaked with cleaning fluid where contamination is released by act of the chemicals together with mechanical forces from the rotation of the shaft. The method is considered efficient and fruitful. The rotor speed at crank wash is a fraction of the speed prevailing at normal operation. One important property with crank washing is that the rotor is rotating at low velocity whereby there is little risk for mechanical damage. While practicing this method the gas turbine must be taken out of service which may cause production loss and costs.

U.S. Pat. No. 5,011,540 discloses a method for wetting of compressor components while the gas turbine is in operation. This method is known as "on-line" washing and is characterized by fuel is being fired in the gas turbine combustor during washing. The method has in common with the crank wash method in that liquid is injected up stream of the compressor. This method is not as efficient as the crank wash method. The lower efficiency relates to poor washing mechanisms prevailing at high rotor speeds when the gas turbine is in operation. For example, a correct dose of liquid must be injected as a too high dose may cause mechanical damage to the compressor and a too low dose may cause poor wetting of the compressor components. Further, the droplets must be small else large droplets may cause erosion damage from the collision of the droplets with the rotor and stator blades.

A gas turbine compressor is designed to compress the incoming air. In the rotor the rotor energy is transformed into kinetic energy by the rotor blade. In the subsequent stator vane the kinetic energy is transformed into a pressure rise by a velocity reduction. To enable the compression process high velocities are required. For example, it is common that the rotor tip of modern gas turbines exceeds the velocity of sound. This means that the axial velocity in the compressor inlet is very high, typically 0.3-0.6 Mach or 100-200 m/s.

According to state of the art technology, wash liquid is pumped at high pressure in a conduit to a nozzle on the duct wall upstream of the compressor inlet. In the nozzle the liquid reaches high velocity whereof atomization takes place and a spray of droplets are formed. The spray is caught by the air stream and the droplets carried with the air stream into the compressor. By the choice of nozzle design small or large droplets can be formed. Alternatively, a nozzle for small droplets can be used. With small droplets in this context means droplets with a diameter of less than 150 μm. The disadvantage with small droplets is that have a small mass and thereby low inertia when leaving the nozzle. The droplets velocity is quickly reduced by the air resistance and the range is therefore limited. Alternatively can a nozzle for large droplets be selected. With large droplets in this context means droplets with a size greater than 150 μm. Large droplets have the advantage of a high inertia when leaving the nozzle. The relationship between the droplet size and its mass is that the mass is proportional to the radius cubed. For example, a 200 μm droplet is twice the size of a 100 μm droplet but has eight times its mass. Through the greater mass follows a greater range compared to the smaller droplet. The disadvantage with the larger droplet is that when the droplets are caught by the air stream they also achieve high velocity towards the compressor. At impact with the blade surface large energies are transferred whereof there may be damage on the blade surface. The damages will appear as erosion damages.

To achieve a good washing effect the spray must penetrate into the core of the air stream. A difficulty with the on-line wash method, e.g. as shown in U.S. Pat. No. 5,011,540 is to get the liquid into the core of the air duct. As previously mentioned there are very high velocities in the air duct which drags the wash liquid before it has penetrated into the core of the air stream. Thereby, the droplets must be small as to avoid erosion damage. However, small droplets show a disadvantage in this respect. Small droplets has low inertia, as off its low mass, and quickly loose velocity when the atomization is completed. In contrary to large droplets which has a good ability to maintain initial velocity over a longer range. A spray of small droplets has therefore an impaired ability to penetrate into the core of the air stream. This problem is especially evident for large gas turbines with large air duct geometries where the distance from the nozzle to the centre of the air duct is long.

In summary, the washing of gas turbines, especially during gas turbine operation, is associated with a number of problems.

SUMMARY OF THE INVENTION

One objective with the invention is to provide a nozzle and a method for washing of a gas turbine during operation in an efficient and safe way.

This and other objectives are achieved by this invention with a nozzle and a method which have the characteristics defined by the independent claims. The preferred embodiments are defined in the dependent claims.

For the purpose of clarification the use of "angle against shaft centre" or "angle against centre axis" means the angle between the direction of a liquid stream from a nozzle and a reference surface parallel with the centre axis through the nozzle body.

According to the first aspect of the invention, a nozzle is disclosed for washing of a gas turbine unit. The nozzle is arranged for atomizing a washing fluid in the air stream of an air inlet duct to said gas turbine unit including a nozzle barrel which, in turn, includes an inlet end for inlet of said washing fluid and an outlet end for outlet of said washing fluid. The nozzle includes further multiple orifices at the outlet end where the orifice is arranged at a defined distance from the nozzle barrel shaft axis.

According to a second aspect of the invention, a method is disclosed for washing of a gas turbine unit comprising of atomizing a wash fluid in an air intake of said gas turbine unit comprising of an inlet end for entering wash liquid and an exit end for releasing said wash fluid. The method is characterized by the formation of said atomized wash fluid by feeding said wash fluid to said orifice at nozzle exit end, whereof each orifice is arranged at suitable distance from the nozzle body centre axis.

The invention is based on the idea of increasing the local density of the atomized wash fluid in a specified volume by feeding the wash fluid through multiple orifices of the nozzle barrel arranged at suitable distances from the nozzle barrel centre axis. This arrangement will allow an improved penetration of the spray into the air stream with maintained droplet size, or even with decreased droplet size, i.e. the nozzle according to the invention will allow wash fluid to be injected into the core of the air stream in the air duct without increasing the droplet size. Thereby will the risk for erosion damage on gas turbine components be reduced while a high efficiency wash will be obtained compared to conventional solutions.

Another advantage is that the nozzle may be equally applied to gas turbines with small geometries as well as gas turbines with large geometries.

Yet another advantage is that washing of components in the gas turbine unit can be practiced during gas turbine operation with significant cost savings. Another advantage is that the nozzle according to the invention can be used for crank washing.

According to preferred embodiment of the invention each orifice is pointing at an angle towards the nozzle centre axis so that the liquid will exit the orifice towards the centre axis. Thereby will the liquid jet from an orifice be within an angle range of 0-80° and preferred within an angle range 10-70°.

By directing the orifice in a suitable angle towards the nozzle centre axis a preferred coverage can be obtained which means that the spray shall have a spray angle as to satisfactory wet the rotor blades and stator vanes within the segment of the compressor inlet where the spray will act. The condition for coverage is thereby fulfilled by selecting a nozzle with the appropriate spray angle. By directing the orifice in a suitable angle towards the centre axis an increased spray density can locally be obtained and a better penetration of the fluid into the air stream can be obtained.

The advantage by the invention is further enhanced by the spray shape shows a smaller projected area against the air stream compared to the spray from a conventional nozzle. By the smaller projected area the spray will not that easy be caught by the air stream but instead penetrate better into the air stream.

According to the preferred embodiment of the invention each of the said orifices is positioned at essentially the same distance from said centre axis and at essentially the same angle towards the centre axis. This design is found to be advantageous in increasing the local density of the spray in the desired area and thereby reduce the risk for erosion damage on the gas turbine components while maintaining a high washing efficiency.

According to an exemplified embodiment of the invention are the orifice arranged as to point towards the centre axis and have a common conjunction point in the range 5-30 cm from said orifice.

Preferably shall the liquid pressure be in the range 35-175 bar.

Preferably are the orifices arranged as to bring the liquid through the orifice at a velocity in the range 70-250 m/s.

According to the preferred embodiment of the invention are the orifices of essentially the same design.

According to a preferred embodiment of the invention is the orifice designed to form a spray with an essentially circular spray pattern, i.e. a spray with a essentially circular cross section. Alternatively may the orifice be arranged to form a spray of an essentially elliptical shape or an essentially rectangular shape.

According to a preferred embodiment of the invention there are two orifices in connection to said outlet end of the nozzle barrel. By using two orifices somewhat apart from each other and allowing the sprays to converge at a point after completion of the atomization, the core of the air stream is reached. Within the volume where the two sprays merge, the density of the spray will double and increasing the impact force on the surrounding air, followed by a better penetration into the air stream, followed by a more efficient wash and a reduced risk for erosion damaged on the compressor components as the droplets are allowed to remain small, i.e. with a diameter less than 150 μm.

Additional advantages with the invention will be obvious by the following detailed descriptions in the preferred embodiments of the invention.

BRIEF DESCRIPTION OF THE DRAWINGS

The preferred embodiments of the invention will now be described in detail with reference to the attached drawings where.

DETAILED DESCRIPTION OF THE PREFERRED EMBODIMENTS

Figure 1:
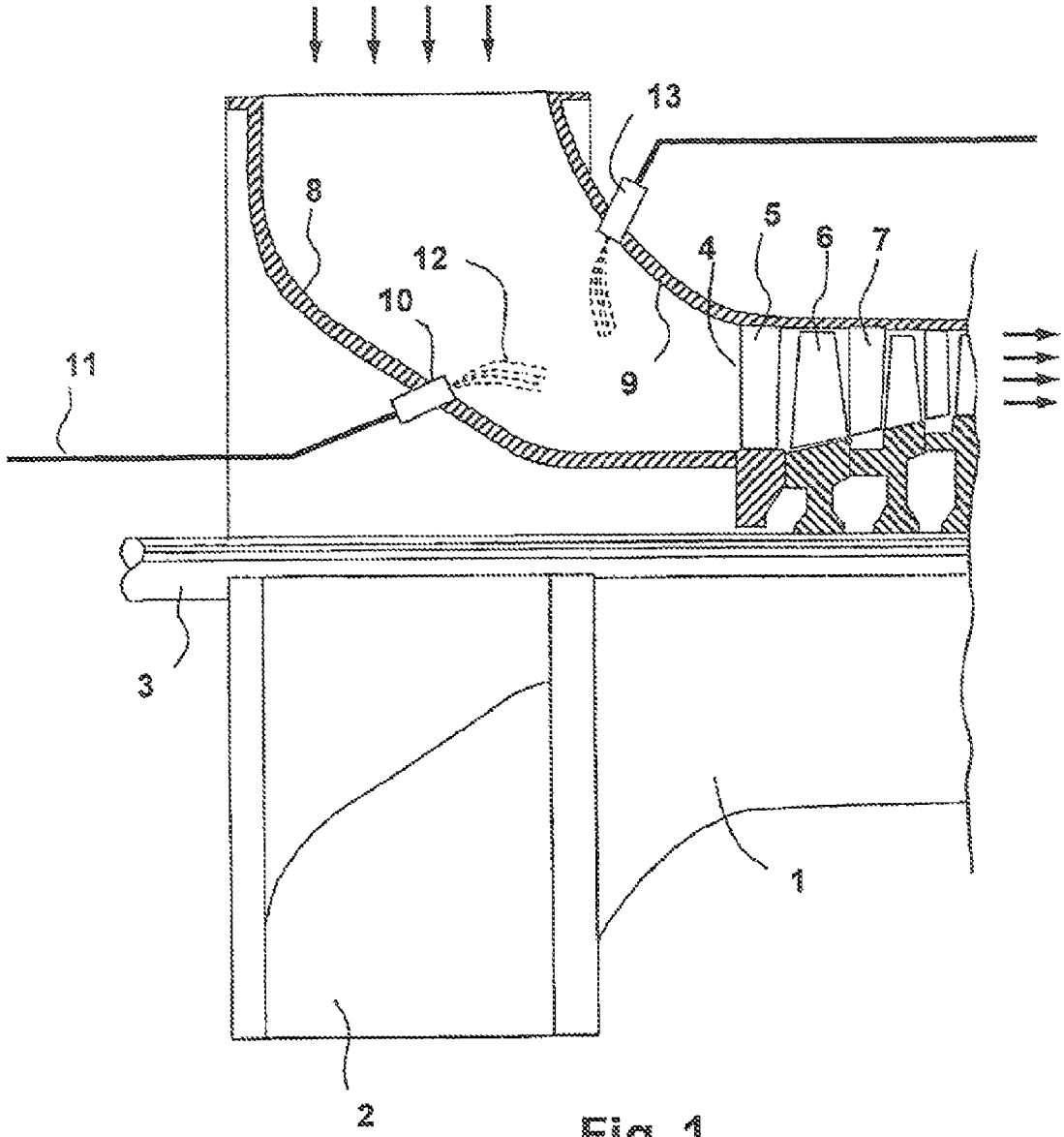
FIG. 1 shows a part of a gas turbine and positioning of nozzles for injecting wash fluid into the air stream.

With reference to FIG. 1, a section of a gas turbine 1 and the positioning of nozzles for injecting of wash liquid into a compressor inlet are shown. The gas turbine comprises of an air intake 2 which is rotationally symmetric to axis 3. The air flow is indicated by arrows. Air enters radially to be rerouted and flow parallel to the machine shaft through compressor 14. Compressor 14 has an inlet 4 at the leading edge of the first disc of stator vanes. After disc 5 with stator vanes follows a disc 6 with rotor blades, followed by a disk 7 with stator vanes, and so on. The air intake has an inner duct wall 8 and an outer duct wall 9. A nozzle 10 is installed on the inner duct wall. A conduit 11 connects the nozzle with a pump (not shown) which supplies the nozzle with wash fluid. After passing nozzle 10 the liquid atomizes and forms a spray 12. The droplets are carried with the air stream to compressor inlet 4. Alternatively, nozzle 13 is installed on the outer air duct wall 9.

Figure 2:
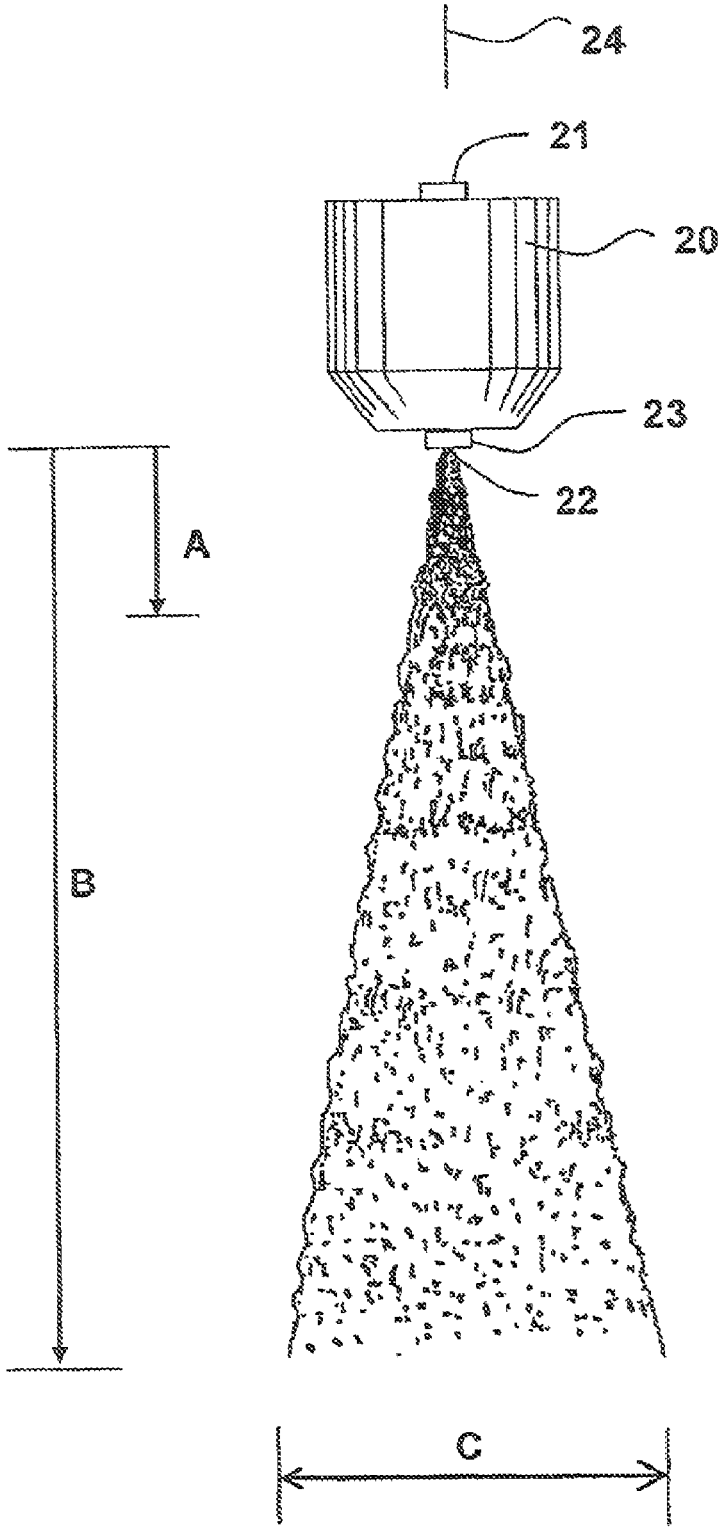
FIG. 2 shows atomization of wash fluid in a nozzle.

FIG. 2 shows atomization of a fluid from a nozzle. A nozzle 20 with an axis 24 has an inlet 21 for the wash fluid and an orifice 22 where the liquid exit the nozzle. The orifice area and liquid pressure is adapted for a specific flow rate. Orifice 23 has a hole where the wash fluid flows. A nozzle for gas turbine compressor washing has an orifice area and a liquid pressure such as that the liquid velocity through the orifice is high, in the order of 100 m/s.

The direction of flow will be direction of which the orifice is pointing. If the orifice is circular a spray with a circular cross section will form. The spray will propagate with one component in the hole's axial direction and another component in the direction perpendicular to the axial direction. According to FIG. 2, the geometry of the spray can be described as a cone with base C and height B and where C is the cone's diameter.

After the liquid has left the orifice the atomization takes place implying that the liquid first is fragmentized followed by a breakdown into small particles. The particles finally take the shape of a sphere governed by that the surface tension is minimized. At a distance A from the orifice 22 according to FIG. 2, the atomization is essentially completed. A spray consisting of droplets of varying size is then formed. For a nozzle in this gas turbine application, operating at a liquid pressure of 70-140 bar, the distance A is typically 5-20 cm. At an additional distance B the droplets have continued to propagate but it is now greater distances between the droplets. When the distances between the droplets become bigger, this means that the spray density is reduced. If the was fluid is assumed to be water, the density before atomization takes place is 1000 kg/m$^3$. At distance B the spray is characterized as having a less density than at distance A where density is defined as the number of particles by volume air locally. For a nozzle in this gas turbine application operating at a liquid pressure of 50-140 bars, the density at A is typically 20 kg/m$^3$.

Ii is evident that when the droplets collide with the air molecules the velocity is reduced. In the context of this invention, a key issue is how far the spray penetrates the air before the air stream has reached the compressor inlet. A single droplet with a certain initial velocity will quickly loose its initial velocity and asymptotically reach zero velocity. The man skilled in the art can estimate the droplets velocity as a function of the distance from the orifice by the use of the balance for the aerodynamic drag force and the force by inertia. For the spray as a whole, it shall displace the air in its way. This can be seen as it has an impinging force on the air characterized by its density, volume flow and velocity. The impact force can be estimated as:

$$F = dens*Q*V*Cd \quad \text{(equation. 1)}$$

where

F=impact force dens=density

Q=volume flow

V=velocity

Cd=de-acceleration coefficient

The de-acceleration coefficient is estimated from the balance between the droplet aerodynamic drag force and the force of inertia.

For the wash procedure according to the invention it is important that the spray well penetrates the air stream. This will occur with a high impinging force as per the definition above. Further, for a good wash result it is required that the spray has a good coverage. By coverage means that the spray shall have a spray angle to satisfactory cover rotor blades and stator vanes within the segment that the spray is acting. The condition for coverage is satisfied by a nozzle with a defined spray angle.

The spray as per above is characterized by its impingement force being highest at the nozzle orifice and the decrease with the distance from the orifice. If the wash fluid is assumed to be water, the density is 1000 kg/m$^3$. The area is estimated from the hole diameter. At each distance from the nozzle orifice the impingement force can then be estimated from equation 1. The increased area with the increased distance result in that the impingement force will asymptotically be zero.

Figure 3:
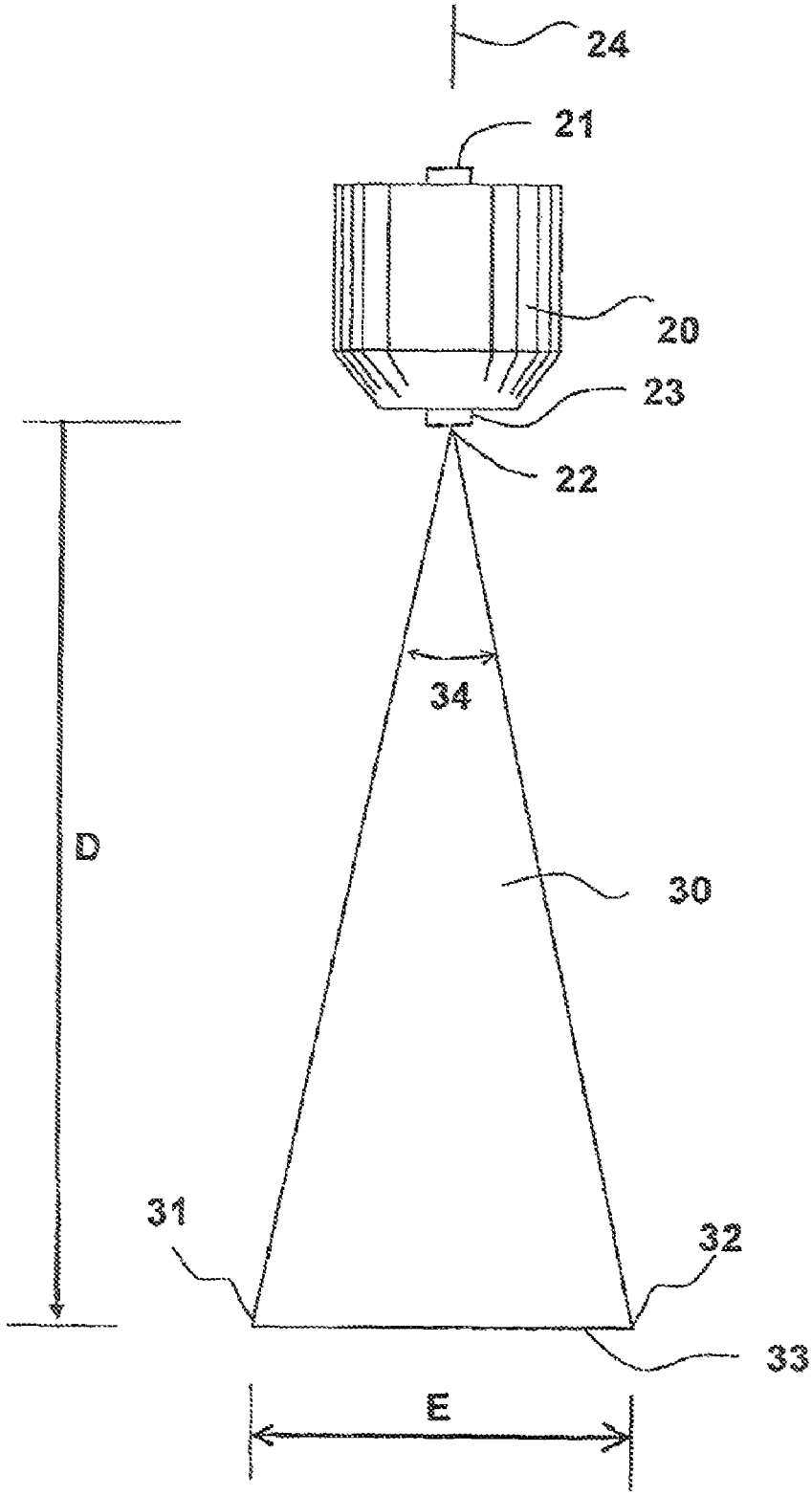
FIG. 3 shows a conventional nozzle for injection of wash liquid into a gas turbine inlet FIG. 4. shows the nozzle according to the invention and a first exemplary embodiment of the invention.

FIG. 3 show the same spray as shown in FIG. 2, where identical parts have the same reference numerals as in FIG. 2. FIG. 3 shows a conventional nozzle. Distance D is the distance the spray has penetrated the air stream before the air stream has transported the droplets to the compressor inlet. The condition for coverage is fulfilled by choice of nozzle with spray angle 34 resulting in coverage E at distance D.

In the description above a spray with a circular projection is assumed. By selecting a nozzle with appropriate orifice geometry, an elliptic or rectangular spray is formed. In the art of gas turbine compressor washing non-circular sprays are used.

Figure 4:
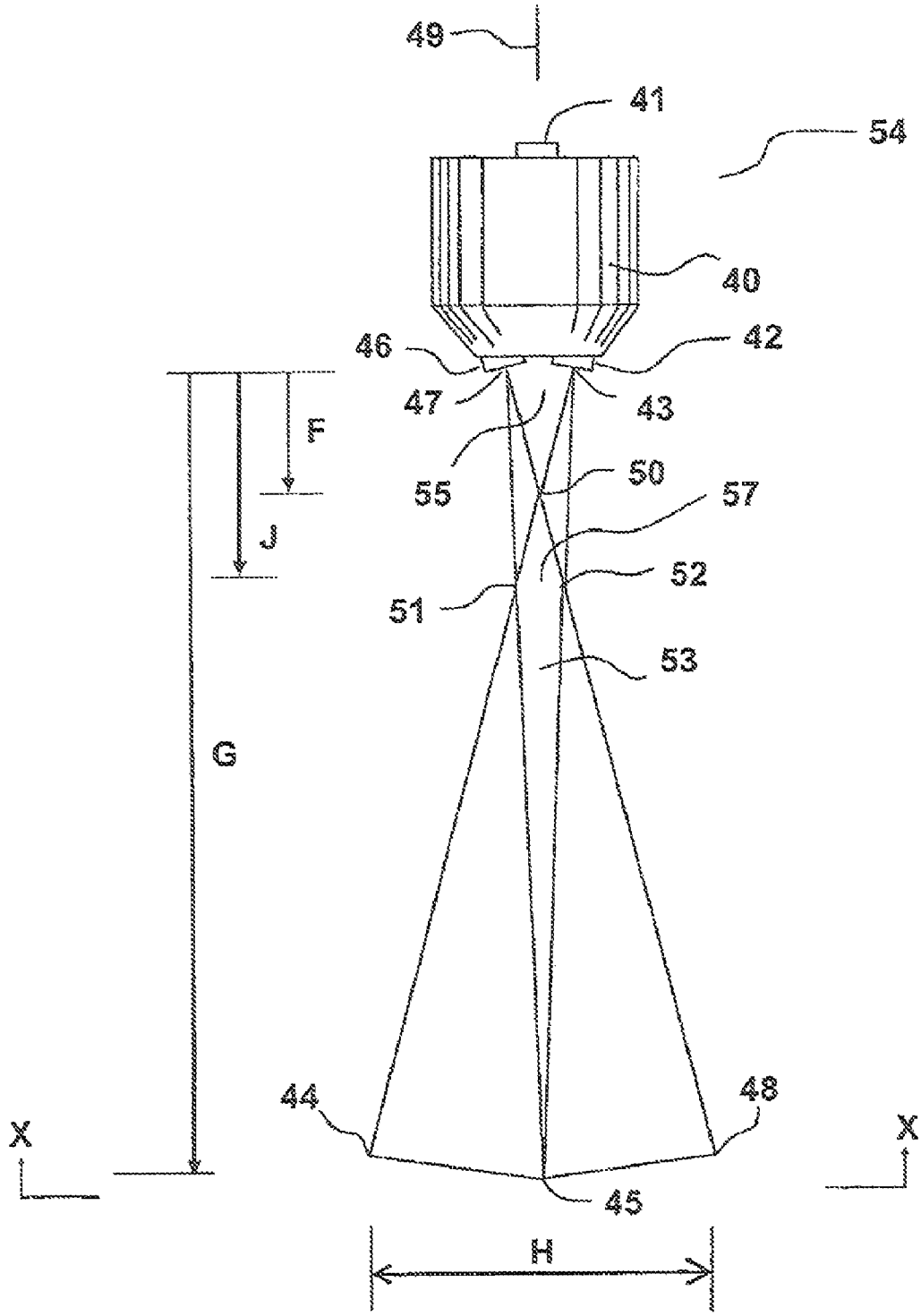
Figure 5:
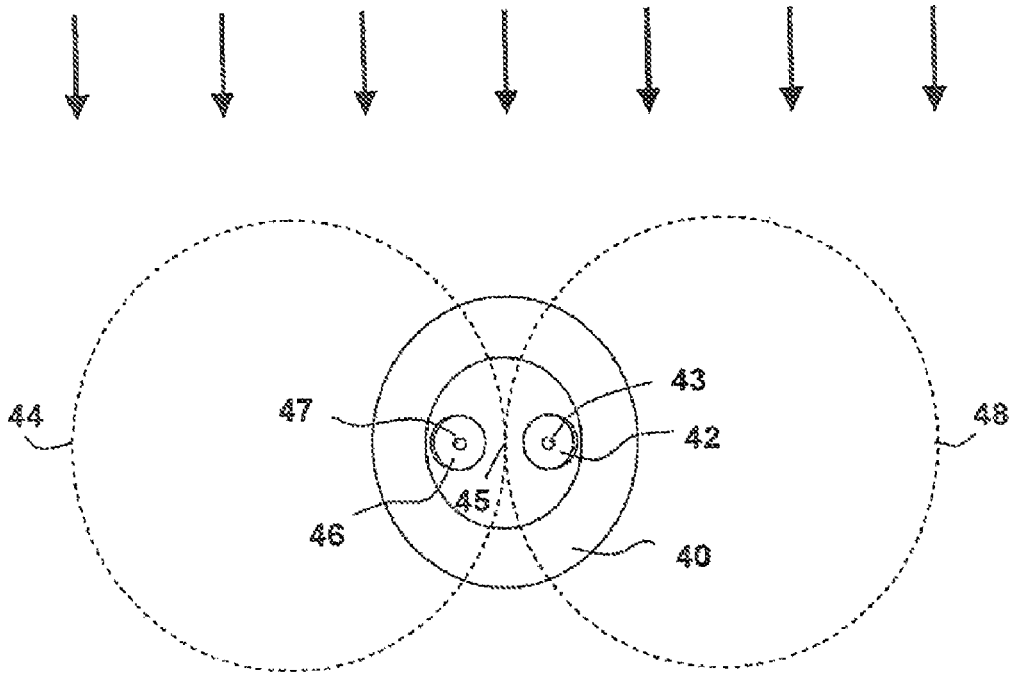
FIG. 5 shows the nozzle according to the first exemplary embodiment of the invention.

With reference to FIG. 4 and FIG. 5, a first preferred embodiment of the invention is shown. The invention relates to a nozzle performing a spray with an increased impaction force. With the increased impaction force will the distance D according to FIG. 3, increase and thereby will the earlier identified problem of penetration into the core of the air stream, be eliminated or partly eliminated. FIG. 4 shows a nozzle according to the invention. A nozzle 54 includes a nozzle barrel 40 with a centre axis 49 with an opening 41 for entering a washing fluid and a first orifice 42 at the outlet end 55 and orifice 42 has an opening 43 where washing fluid exits the nozzle. The first orifice 42 is positioned off side the centre axis 49 and with an angle pointing towards the centre axis so that the formed spray is directed to the centre axis. The spray that is formed is circular. The spray geometry can be described as a cone with a base line with one end 44 and another end 45 and tip 43. Nozzle 54 has a second orifice 46 at the outlet end 55 and orifice 46 has an opening 47 where fluid exits the nozzle. Orifice 46 is positioned off side the centre axis 49 and with an angle pointing towards the centre axis so that the formed spray is directed to the centre axis. The spray that is formed is circular. The spray geometry can be described as a cone with a base line in between one end 45 and another end 48 and tip 47. According to the preferred embodiment of the invention the orifices are directed at angles towards the centre axis so that the fluid from one orifice is preferably within the angle range 0-80° and additionally preferably within the angle range 10-70°.

The two orifice openings have the same hole area and the alike geometry whereby the incoming liquid is equally distributed between the two orifice 42 and 46. The two orifice openings are directed-towards the centre axis at a junction point 57 at distance J from the orifice openings. Distance J is within the range 5-20 cm.

The liquid is atomized when exiting the orifice openings 43 and 47. At a distance F from the orifice openings the atomization is in general completed. The two sprays will now merge whereby a zone 53 is formed with increased density by merging of the two sprays. Zone 53 is limited by points 50, 52, 45, 51 and 50. With the increased density follows an increased impingement force according to equation 1. It is the purpose of the invention to increase the impingement force. By a suitable nozzle spray angle and spray direction the requirements of coverage H at distance G is fulfilled.

FIG. 5 shows the nozzle in the perspective X-X, where like parts are indicated with the same reference numerals as in FIG. 4. FIG. 5 shows the orientation of the orifices 42 and 46 with respect to the direction of the air stream. The direction of the air stream is indicated with arrows.

The effect of the invention is further improved by the fact that the spray in accordance with FIG. 4 discloses a projected area against the air stream that is smaller in comparison with the spray from a conventional nozzle. With the direction of stream in accordance with FIG. 5 the projected area against the air stream the area between the points 47, 50, 43, 52, 48, 45, 44, 51 and 47 in FIG. 4. This area should be compared with the projected area that results at use of a conventional nozzle in accordance with FIG. 3, where this area constitutes the area between the points 22, 31, 32 and 22. The area in FIG. 3 is larger than corresponding area in FIG. 4. Due to the smaller projected area, the spray is not caught by the air stream that easy and thereby the spray is able to penetrate the air stream in a more effective manner.

Figure 6:
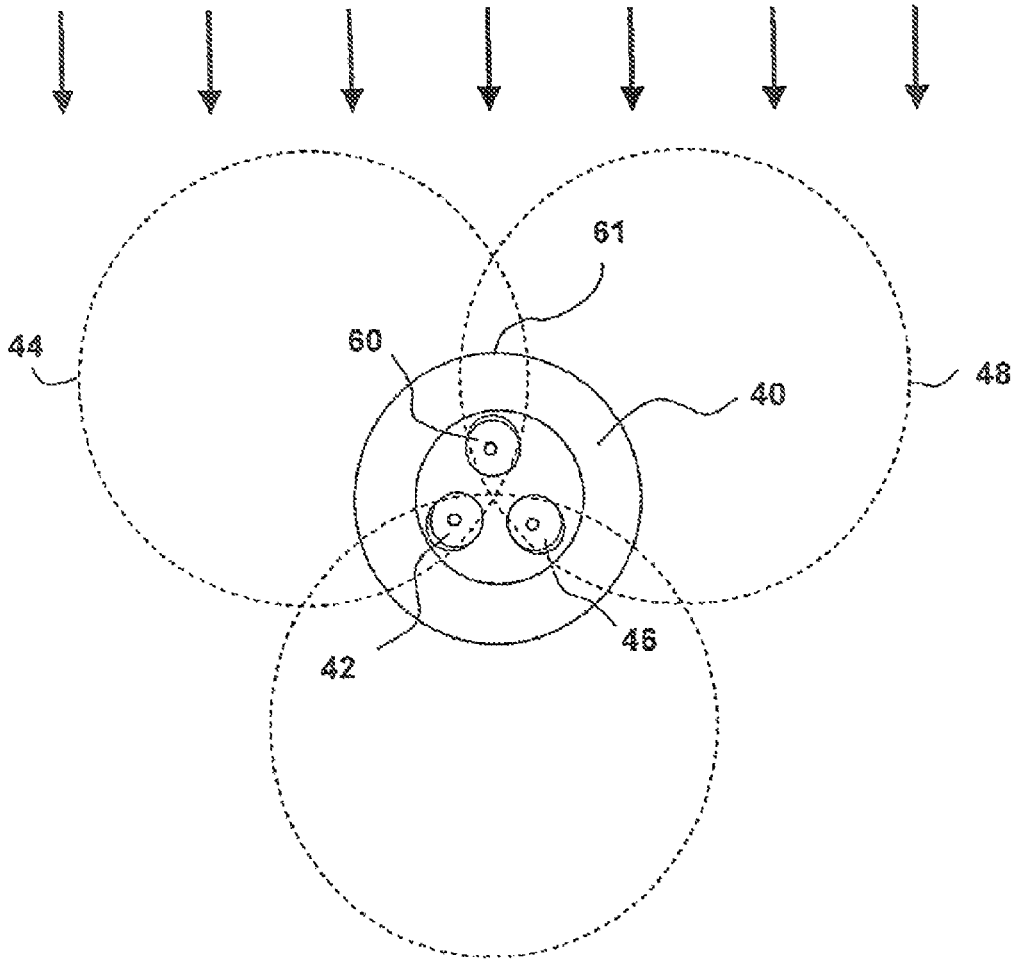
FIG. 6 shows the nozzle according to the invention and a second exemplary embodiment of the invention.

With reference now to FIG. 6, a nozzle in accordance with the present invention that exemplifies a second embodiment of the invention will be shown. FIG. 6 shows the nozzle in the perspective X-X, where like parts are indicated with the same reference numerals as in FIG. 4. As the function of this embodiment of the nozzle in accordance with the present invention is substantially the same as the function of the above-described embodiment such a description of the function is omitted here. FIG. 6 shows the orientation of the orifices 42, 46 and 60 with respect to the direction of the air stream. The orifice 60 has, as the orifices 42 and 46, an opening 61 where the fluid leaves the nozzle. The direction of the air stream is indicated with arrows. The third orifice 60 is mounted at the side of the axis centre at the same distance from the axis centre 49 and at the same angle as the orifices 42 and 46 such that the formed spray is directed against the axis centre in a corresponding manner as in the above-discussed embodiment.

Even if the presently preferred embodiments of the invention has been described, it is from the above description obvious for the man skilled within the art that variations of the present embodiments can be realized without departing from the scope of the principles of the invention.

Thus, the intention is not that the invention should be limited only to the structural and functional elements described with reference to the embodiments but only by the appended patent claims.

The invention claimed is:

1. A method for washing a gas turbine unit comprising:

atomizing a wash liquid in an air intake of said gas turbine unit by using a nozzle, said nozzle comprising a nozzle body comprising an intake end for intake of said wash liquid, an outlet end for exit of said wash liquid, and a number of orifices connected to said outlet end, said orifices having orifice openings;

producing said atomized wash liquid by delivering said liquid to said orifices, wherein said orifices are directed towards a center axis of said nozzle body at a junction point at a distance within a range of 5-30 cm from said orifice openings and at an angle towards the center axis so that the liquid emanating from respective orifice opening is within an angle range of ≧0-80°.

2. The method according to claim 1 wherein said orifices are disposed at substantially the same distance from said center axis and at substantially the same angle with respect to said axis.

3. The method according to claim 1 wherein said delivering said liquid to said orifices comprises delivering said liquid to said orifices at a liquid pressure in the range of 35-175 bar.

4. The method according to claim 3 wherein said orifice openings are arranged to, in cooperation with said liquid pressure, cause said liquid to stream out with a liquid velocity in the range of 50-250 m/s.

5. The method according to claim 1 wherein said orifice openings have substantially the same design.

6. The method according to claim 1 wherein said orifices are arranged to form a spray into a form in accordance with any one of from the group of substantially circular, substantially elliptical, or substantially rectangular.

7. The method according to claim 1, wherein two orifices are connected to said outlet end.

8. A method for washing a gas turbine unit comprising:

providing a nozzle apparatus comprising:

an intake end for intake of said wash liquid and outlet end for exit of said wash liquid, and a center axis;

a number of orifices connected to the outlet end and having one or more orifice openings for atomizing wash liquid; wherein said orifices are directed at an angle towards said center axis at a junction point at a distance within a range of 5-30 cm from said orifice openings, and wherein said orifices are configured so that liquid emanates from said orifice openings at a spray angle that is within an angle range of >0-80°;

installing said nozzle apparatus on an air intake of the gas turbine unit;

atomizing wash liquid in said air intake of said gas turbine unit by using said nozzle apparatus, said nozzle comprising a nozzle body comprising an intake end for intake of said wash liquid, an outlet end for exit of said wash liquid, and a number of orifices connected to said outlet end, said orifices having orifice openings; and injecting said atomized wash liquid into said gas turbine unit.

9. The method according to claim 8, wherein said orifices are disposed at substantially the same distance from said center axis and at substantially the same angle with respect to said axis.

10. The method according to claim 8, further delivering said wash liquid to said orifices at a liquid pressure in the range of 35-175 bar.

11. The method according to claim 10, wherein said orifice openings are arranged to, in cooperation with said liquid pressure, cause said wash liquid to stream out with a liquid velocity in the range of 50-250 m/s.

12. The method according to claim 8, wherein said orifice openings have substantially the same design.

13. The method according to claim 8, wherein said orifices are arranged to form a spray arrangement according to at least one of the group consisting of substantially circular, substantially elliptical, and substantially rectangular.

14. The method according to claim 8, wherein two orifices are connected to said outlet end.

* * * * *